United States Patent [19]

Garland

[11] 4,100,757

[45] Jul. 18, 1978

[54] CLOSED CIRCUIT AMMONIA SYSTEM FOR LIQUID HEATING FROM WATER

[75] Inventor: Milton W. Garland, Waynesboro, Pa.

[73] Assignee: Frick Company, Waynesboro, Pa.

[21] Appl. No.: 793,651

[22] Filed: May 4, 1977

[51] Int. Cl.[2] ..... F17C 7/02

[52] U.S. Cl. ..... 62/52; 122/33; 165/39; 165/105

[58] Field of Search ..... 122/33; 165/39, 105; 62/52; 60/648, 649

[56] References Cited

U.S. PATENT DOCUMENTS

| | | | |
|---|---|---|---|
| 2,119,091 | 5/1938 | Atkinson | 122/33 X |
| 3,421,574 | 1/1969 | Kals | 62/52 |
| 3,535,210 | 10/1970 | Linde et al. | 62/52 X |
| 3,712,073 | 1/1973 | Arenson | 122/33 X |
| 3,738,353 | 6/1973 | Santoleri | 165/39 X |

*Primary Examiner*—Allen M. Ostrager
*Attorney, Agent, or Firm*—Dowell & Dowell

[57] ABSTRACT

Liquid ammonia at a temperature of approximately −28° F has its temperature raised to a level more suitable for transporting it, e.g. 40° F, by passing it in heat exchange relation with higher temperature ammonia vapor which results from passing a liquid, such as water, from a waste heat source, in heat exchange relation with the ammonia, the vapor then condensing and the condensate returning to the heat exchange relation with the water, controls being provided to avoid inadvertent freezing of the water.

4 Claims, 2 Drawing Figures

CLOSED CIRCUIT AMMONIA SYSTEM FOR LIQUID HEATING FROM WATER

BACKGROUND OF THE INVENTION

1. Field of the Invention.

This invention relates to the handling of a relatively low temperature liquid, such as ammonia, and more particularly to an indirect system of heat exchange between it and a waste heat source, such as water, which is available at an appropriate temperature in relatively large quantity. The temperature of the ammonia is raised, without changing it from its liquid state, to facilitate its transportation. Provision is made for continuously monitoring the temperatures of the ammonia and the water to accomplish the desired temperature rise and avoid freezing of the water.

2. Description of the Prior Art.

When it is necessary to transport liquid ammonia, its temperature must be raised from approximately −28° F to approximately 40° F in order that it may be shipped in railway tank cars and tank trucks. In the past the heating has been accomplished by the burning of fuel oil and gas.

One of the objects of the invention is to provide for the raising of the temperature of liquid ammonia by heating means which does not require a high temperature heat, such as that obtainable from the burning of fuels, but which, on the other hand, is obtainable from a waste heat source such as a storage pool of water, heated by solar absorption, exhaust steam, or process work in order that energy may be conserved.

The prior art discloses systems for providing super heated gaseous fluid from a low temperature liquid supply in which a closed system is employed. See, for example, the U.S. Pat. No. to Bivins, 3,986,340. Other examples of the prior art include U.S. Pats. to Arenson No. 3,712,073, to Karbosky, No. 3,345,872, to Kals, No. 3,421,574, to Linde et al, No. 3,535,210, and to Ogura et al, No. 3,906,261. Some of these disclose various condition responsive control means whose stated purpose is to avoid or reduce the likelihood of freezing of the water which is used for heating.

SUMMARY OF THE INVENTION

The present invention includes a closed circuit system involving a pair of closed vessels, one above the other. Piping connections extend from the upper portion of the lower to the upper portion of the upper vessel and from the lower portion of the upper to the lower portion of the lower vessel. Separate tubes carry a heating liquid, such as water, through the lower vessel, and the liquid ammonia, whose temperature is to be raised, through the upper vessel. A liquid which is readily vaporizable by the water, and whose vapor is readily condensible by the ammonia, such as ammonia, is heated in the lower vessel by the water, and its vapor passes into the upper vessel where it is condensed as it heats the liquid ammonia passing through the tubes.

In order to prevent the freezing of water in the tubes which pass through the lower vessel, a control arrangement is provided in which the rate of flow of liquid ammonia through the tubes in the upper vessel is subject to the temperature of the water leaving the tubes in the lower vessel.

DESCRIPTION OF THE PREFERRED EMBODIMENT

Figure 1:
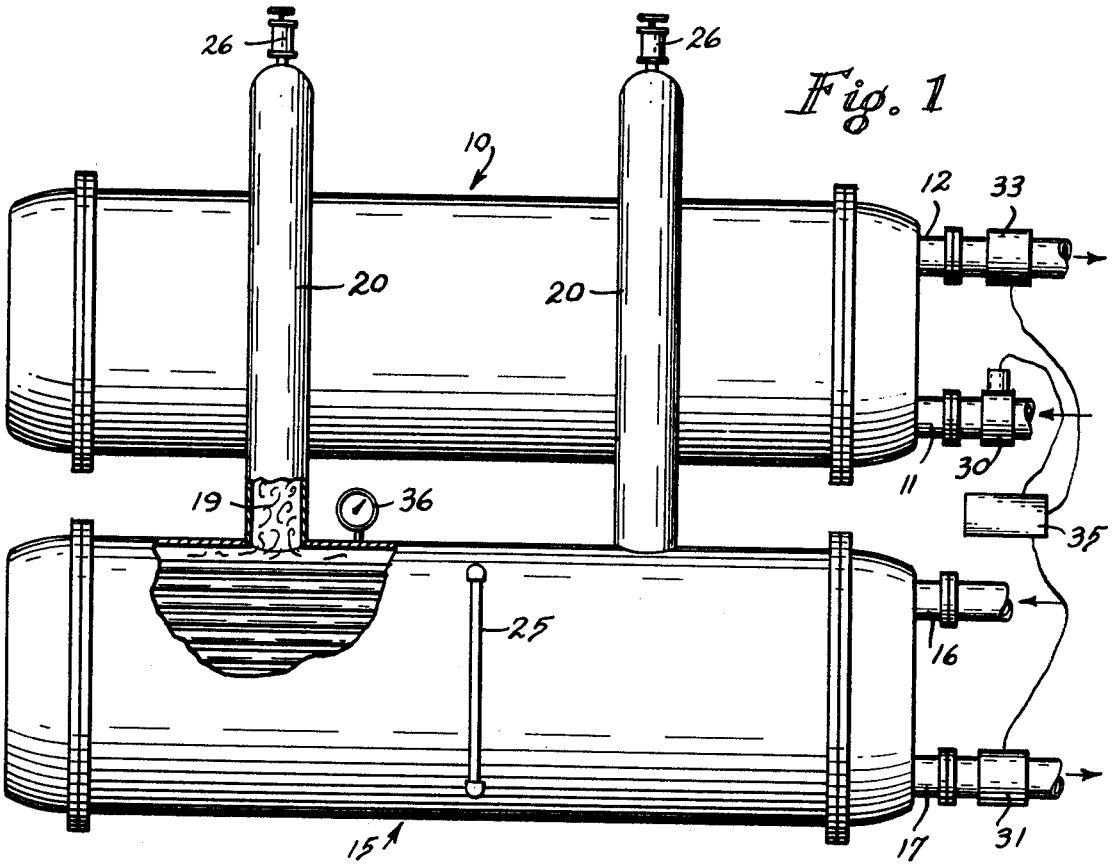
FIG. 1 is a schematic side elevation of a preferred embodiment of the invention.
Figure 2:
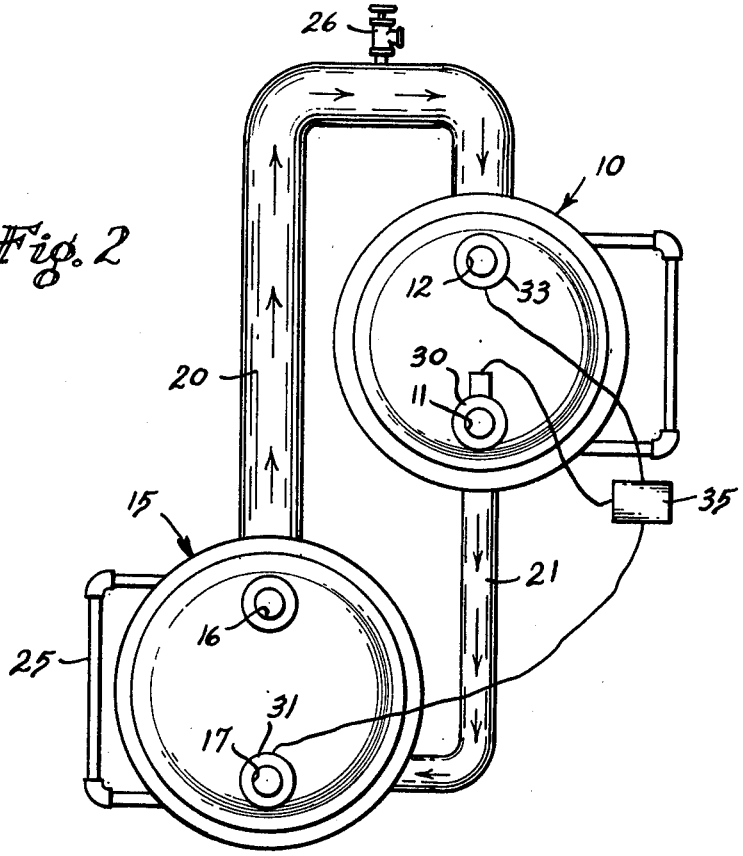
FIG. 2 is an end elevation.

With continued reference to the drawings, a condenser 10, which is preferably of the shell and tube type, having a lower inlet pipe 11 and an upper outlet pipe 12 is mounted at a higher elevation than an evaporator 15, also of the shell and tube type, having an upper inlet pipe 16 and a lower outlet pipe 17. The pipes, 11 and 12, and 16 and 17, are connected internally of the shells in a conventional arrangement to provide multi-pass flow through the internal tubes. The evaporator 15 normally contains a supply of a readily vaporizable liquid, such as ammonia, or the like (not shown).

The upper portions of the shells of condenser 10 and evaporator 15 are connected by a pair of pipes 20 and the lower portions of the shells are connected by one or more pipes 21 only one of which is shown.

In order to indicate the level of the vaporizable liquid in the shell of evaporator 15, a sight glass 25 is connected to the upper and lower portions thereof.

Purge valves 26 are connected to the upper portion of the pipes 20 in order that the space within the shells and the pipes may be evacuated prior to charging of the evaporator with liquid ammonia.

In the normal operation a liquid, such as water, which may be available from a large pool at a convenient working temperature, say approximately 80° F, is obtained from a suitable source and caused to flow through pipe 16 into evaporator 15 where it gives off heat to vaporize the liquid therein after which the water is discharged through pipe 17 at a temperature of approximately 50° F. The water passing through the tubes in evaporator 15 heats the vaporizable liquid within the shell and its vapors 19 pass upwardly through the pipes 20 and into the condenser 10. At the same time, ammonia at a temperature of approximately −28° F enters the pipe 11 of the condenser 10 where it absorbs heat from the ammonia vapor therein and is discharged through the pipe 12 at a temperature of approximately +40° F. Within the condenser shell 10, the ammonia vapor contacts the internal tubes containing cold liquid ammonia and condenses thereon after which the resulting condensate returns by gravity through the pipes 21 into the evaporator 15.

In order to protect the water which is passing through the tubes in the evaporator 15 from freezing a suitable control means is provided. This control means includes a valve 30 on the cold ammonia inlet pipe 11 and a temperature responsive device 31 on the pipe 17 carrying the water leaving the condenser 15. Another temperature responsive device 33 is associated with the pipe 12 of the warmed liquid ammonia leaving the condenser 10. Valve 30 and the temperature responsive devices 31 and 33, are connected to a control box 35. In operation the cold ammonia flow rate in the pipe 11 is responsive to the temperature of the liquid ammonia leaving the condenser by pipe 12 so that the flow may be such as to result in the proper temperature at the sensing means 33. At the same time, the sensing means 31 is operative to override the control means 33 and to reduce the flow through the valve 30 in order to avoid possible freeze-up of the water passing through the tubes in the evaporator 15.

While the heat source has been described as from a large pool of water, it is understood that various waste sources of heat, such as steam, process work and solar energy may be used to provide a relatively low temperature liquid heat source for passing through the evaporator 15.

It is an important feature of the invention that a single heating vessel, such as the evaporator 15, supplies a single condensing vessel. If more than one source is used for heating, for example, an inoperative condition may result because it is known that migration will occur from a warmer vessel into a colder vessel when these are fed from a gravity source. Various prior devices have attempted to use multiple sources of heat, but these are viewed as unsatisfactory or inoperative because of such migration.

In the event that various heat sources are available the heat from the various sources should be exchanged in vessels other than the one that is being used as an evaporator in the system under consideration.

In preparing the apparatus of the present invention for use, the system is first purged by attaching a pump to the purge valves 26. After evacuation, ammonia or other vaporizable liquid is admitted into the shell of the evaporator 15 until the sight glass 25 indicates that the shell is about three-quarters full. Then water at approximately 80° F is circulated through the tubes in evaporator 15. Prior to admitting liquid ammonia at a temperature of approximately −28° F into the tubes in the condenser 10, the pressure in the evaporator shell, as indicated by gauge 36, should register approximately 138.3 pounds per square inch. Should the pressure be higher than that corresponding to the temperature of the water flowing through the evaporator 15, this is an indication that there are non-condensables remaining in the system which must be removed by further purging through valves 26.

I claim:

1. Apparatus for raising the temperature of a liquefied gas which is at a temperature substantially below the freezing point of water, comprising first and second enclosed vessels, the first mounted at a higher elevation than the second, first conduit means connecting the upper portion of the second vessel to the upper portion of the first vessel for the flow of vapor from the second vessel to the first vessel, second conduit means connecting the lower portion of the first vessel to the lower portion of the second vessel for the flow of condensed liquid from the first vessel to the second vessel, first tube means for passing liquefied gas into and out of said first vessel, second tube means for passing a heating liquid into and out of said second vessel, valve means for controlling the flow through said first tube means, temperature responsive means for sensing the temperature of the heating liquid flowing out of said second vessel, and control means responsive to said temperature responsive means for operating the valve means of said first tube means.

2. The invention of claim 1, and second temperature responsive means for sensing the temperature of the liquefied gas in said first tube means leaving said first vessel for selectively operating the valve means of said first tube means.

3. Apparatus for raising the temperature of a liquefied gas which is at a temperatue substantially below the freezing point of water, comprising a first only and a second only shell vessel, the first mounted at a higher elevation than the second, first conduit means connecting the upper portion of the second to the upper portion of the first shell vessel for the flow of vapor from the second to the first, second conduit means connecting the lower portion of the first to the lower portion of the second shell vessel for the flow of condensed liquid from the first to the second, first tube means for passing liquefied gas into and out of said first shell vessel, second tube means for passing a heating liquid into and out of said second shell vessel, valve means for controlling the flow through said first tube means, temperature responsive means for sensing the temperature of the heating liquid flowing through said second tube means and control means responsive to said temperature responsive means for selectively operating the valve means of said first tube means.

4. The invention of claim 3, and second temperature responsive means for sensing the temperature of the liquefied gas in said first tube means leaving said first shell vessel, said second temperature responsive means being connected to said control means to cause said control means to selectively operate said valve means of said first tube means.

* * * * *

UNITED STATES PATENT AND TRADEMARK OFFICE

CERTIFICATE OF CORRECTION

PATENT NO. : 4,100,757

DATED : July 18, 1978

INVENTOR(S) : Milton W. Garland

It is certified that error appears in the above-identified patent and that said Letters Patent are hereby corrected as shown below:

The line for inventorship should be changed to read as follows:

Inventors: Paul M. Schroedter and Milton W. Garland
both of Waynesboro, Pennsylvania

Signed and Sealed this

*Fifteenth* Day of *January 1980*

[SEAL]

*Attest:*

SIDNEY A. DIAMOND

*Attesting Officer* *Commissioner of Patents and Trademarks*